US010919317B2

(12) United States Patent
Samweber

(10) Patent No.: US 10,919,317 B2
(45) Date of Patent: Feb. 16, 2021

(54) METHOD AND PRINTING DEVICE FOR REDUCING DEFORMATIONS OF A RECORDING MEDIUM

(71) Applicant: Océ Holding B.V., Venlo (NL)

(72) Inventor: Joachim Samweber, Eichenau (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/579,797

(22) Filed: Sep. 23, 2019

(65) Prior Publication Data

US 2020/0094584 A1 Mar. 26, 2020

(30) Foreign Application Priority Data

Sep. 26, 2018 (DE) ..... 10 2018 123 711

(51) Int. Cl.
*B41J 11/00* (2006.01)
*B41J 13/00* (2006.01)

(52) U.S. Cl.
CPC ..... *B41J 11/0005* (2013.01); *B41J 13/0009* (2013.01)

(58) Field of Classification Search
CPC ..... B41J 11/0005; B41J 13/0009; B41J 13/03
USPC ..... 347/16
See application file for complete search history.

(56) References Cited

U.S. PATENT DOCUMENTS

2004/0140387 A1* 7/2004 Ishida ..... B65H 23/10 242/417.3
2014/0071195 A1* 3/2014 Richmond ..... B41J 11/0015 347/16

FOREIGN PATENT DOCUMENTS

JP 08-152 840 A 6/1996

OTHER PUBLICATIONS

German Office Action dated Mar. 7, 2019, for Application No. 10 2018 123 711.1.

* cited by examiner

*Primary Examiner* — Huan H Tran
*Assistant Examiner* — Alexander D Shenderov
(74) *Attorney, Agent, or Firm* — Schiff Hardin LLP

(57) ABSTRACT

In preparation for the stop of a printer, a forward and backward movement of the recording medium in the form of a web is implemented so that the segment of the recording medium that is in contact with a roller of the printer given a stop of the printer is moved at least partially before or after the roller. In preparation for the stop, climatic properties of the recording medium may thus be adapted to the climatic properties of the local environment of the roller, where deformations of the recording medium may be advantageously reduced or eliminated.

20 Claims, 3 Drawing Sheets

METHOD AND PRINTING DEVICE FOR REDUCING DEFORMATIONS OF A RECORDING MEDIUM

CROSS REFERENCE TO RELATED APPLICATIONS

This patent application claims priority to German Patent Application No. 102018123711.1, filed Sep. 26, 2018, which is incorporated herein by reference in its entirety.

BACKGROUND

Field

The disclosure relates to a method and a printing device for reducing or avoiding deformations of a recording medium as a result of a stop of the printing device.

Related Art

A printing device, in particular an inkjet printing device, may be configured to print to a recording medium in the form of a band. Such a printing device may be operated in a start-stop mode, in which the printing operation may be intermittently interrupted and subsequently resumed, for example in order to perform a maintenance activity. The recording medium, in the form of a band that is to be printed to, thereby typically remains inside of the printing device.

A printing device typically has rollers, in particular deflection rollers, in order to guide a recording medium in the form of a band through the printing device. Given a stop of the printing device, one or more segments of a recording medium remain in contact with the one or more rollers of the printing device for a longer period of time. This may lead to deformations of the recording medium, and thus if applicable to a reduced print quality and/or to spoilage.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 3A:
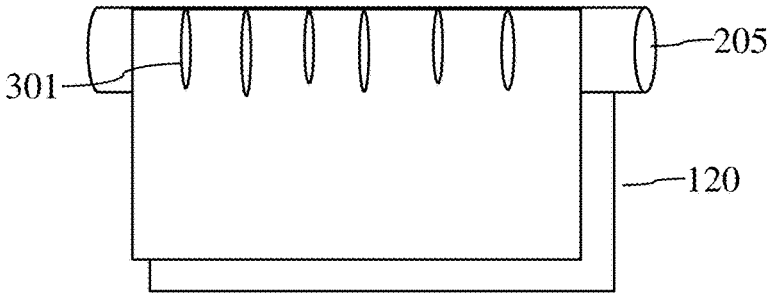

FIG. 3*a* illustrates examples of rhomboidal deformations of a recording medium according to an exemplary embodiment of the present disclosure.

Figure 3B:
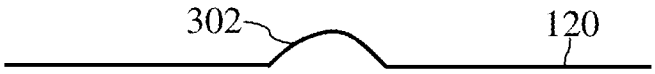

FIG. 3*b* illustrates an example of a "curl" of a recording medium according to an exemplary embodiment of the present disclosure.

Figure 4A:
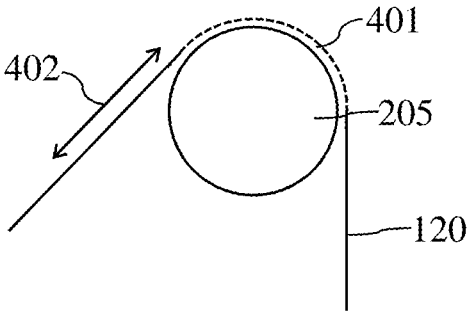

FIG. 4*a* illustrates a cross section of an example of a deflection roller according to an exemplary embodiment of the present disclosure.

Figure 4B:
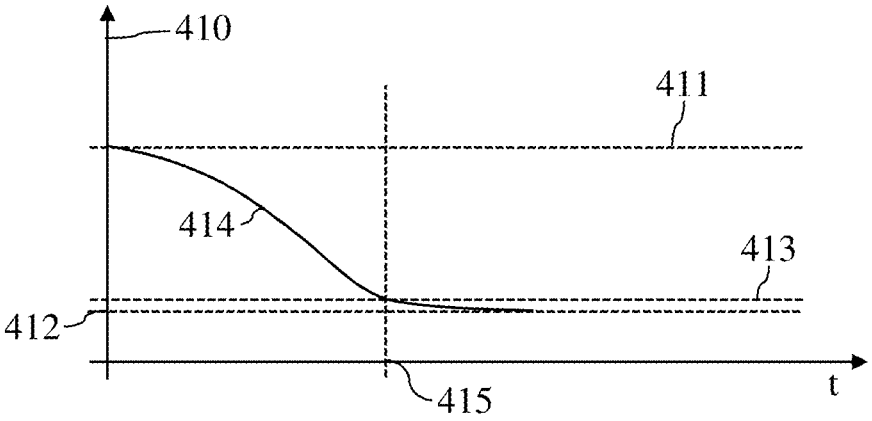

FIG. 4*b* illustrates an example of a time curve of a climatic property of a recording medium according to an exemplary embodiment of the present disclosure.

Figure 5:
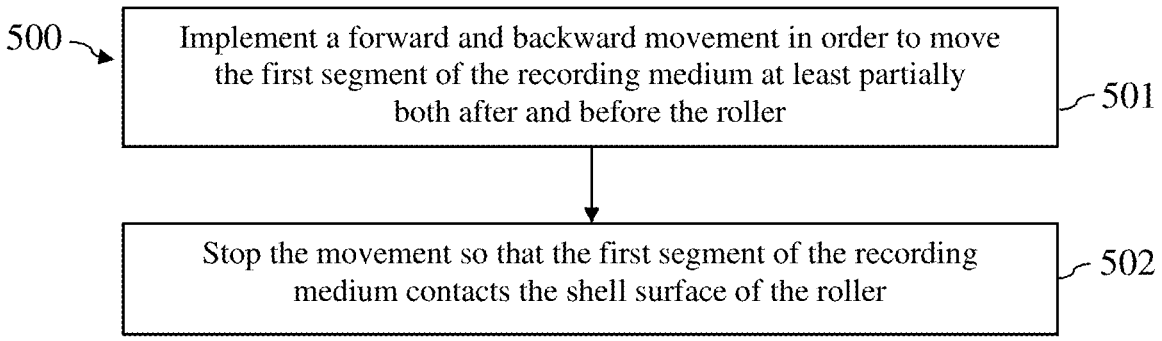

FIG. 5 illustrates a flowchart of a method for reducing the deformation of a recording medium as a result of the stop of a printer according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to efficiently and reliably reduce, or entirely avoid, the deformations of a recording medium that are produced by a start-stop operation of a printer.

According to one aspect of the disclosure, a method is described for reducing the deformation of a recording medium in the form of a web as a result of a stop of the printer. The printer includes at least one roller for guiding the recording medium. In an exemplary embodiment, the method includes the implementation of a forward and backward movement of the recording medium in preparation for a stop of the printer, so that a first segment of the recording medium is arranged at least partially before or at least partially after the roller. Furthermore, subsequent to this, the method includes the stopping of the movement of the recording medium so that the first segment of the recording medium is in contact with the roller during the stop of the printer.

According to a further aspect of the disclosure, a printer for printing to a recording medium in the form of a band is described. The printer includes at least one drive that is configured to move the recording medium. In an exemplary embodiment, the printer includes at least one roller for guiding the recording medium. Furthermore, the printer includes a controller that is configured to induce the drive, in preparation for a stop of the printer, to produce a forward and backward movement of the recording medium so that a first segment of the recording medium is arranged at least partially before or at least partially after the roller during said forward and backward movement. Furthermore, the controller is configured to, following this, induce the drive to stop the movement of the recording medium so that the first segment of the recording medium is in contact with the roller during the stop of the printer.

Figure 1:
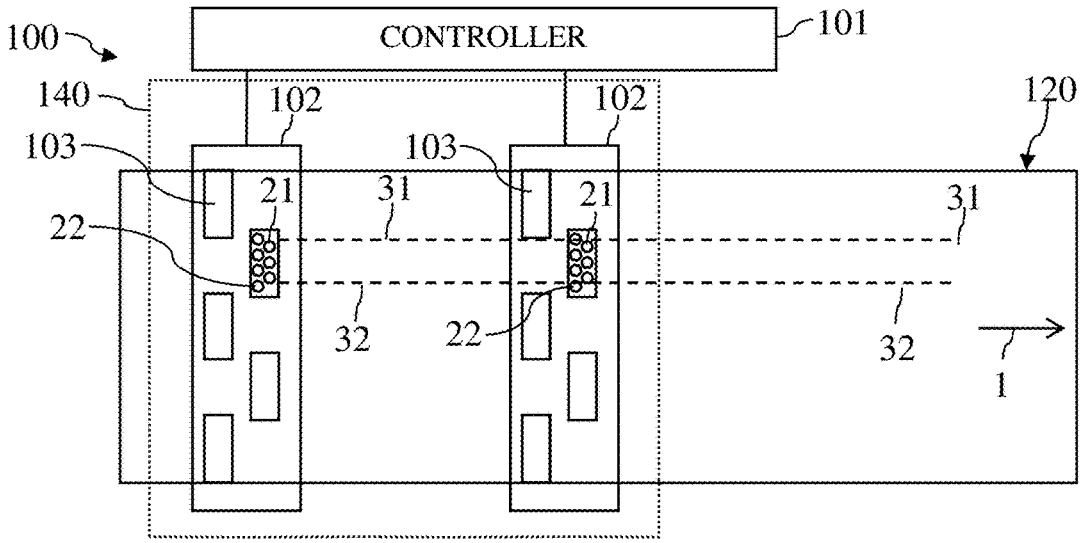
FIG. 1 illustrates a block diagram of an inkjet printer according to an exemplary embodiment of the present disclosure.

The printer 100 illustrated in FIG. 1 is configured for printing to a recording medium 120 in the form of band/web. The recording medium 120 may have been produced from paper, paperboard, cardboard, metal, plastic, textiles, a combination thereof, and/or other materials that are suitable and can be printed to. The recording medium 120 is directed along the transport direction 1 (represented by an arrow) through the print group 140 of the printer 100. The recording medium 120 in the form of a web may thereby be taken off of a roll. After printing, the recording medium 120 may possibly be cut into sheets. It is noted that the aspects that are described in this document are also applicable to other types of printers, for instance to toner-based printers.

In an exemplary embodiment, the print group 140 of the printer 100 includes two print bars 102, wherein each print bar 102 may be used for printing with ink of a defined color (for example black, cyan, magenta, and/or yellow, and Magnetic Ink Character Recognition (MICR) ink if applicable). Different print bars 102 may be used for printing with respective different inks. Furthermore, the printer 100 typically includes at least one fixer or dryer (not shown) that is configured to fix a print image printed onto the recording medium 120.

In an exemplary embodiment, print bar 102 includes one or more print heads 103 that are, if applicable, arranged side by side in multiple rows in order to print the dots of different columns 31, 32 of a print image onto the recording medium 120. In the example depicted in FIG. 1*a*, a print bar 102 includes five print heads 103, wherein each print head 103 prints the dots of a group of columns 31, 32 of a print image onto the recording medium 120.

In the embodiment depicted in FIG. 1, each print head 103 of the print group 140 includes a plurality of nozzles 21, 22, wherein each nozzle 21, 22 is configured to fire or eject ink droplets onto the recording medium 120. A print head 103 of the print group 140 may, for example, include multiple thousands of effectively utilized nozzles 21, 22 that are arranged along multiple rows, transversal to the transport direction 1 of the recording medium 120. By the nozzles 21, 22 of a print head 103 of the print group 140, dots of a line of a print image may be printed onto the recording medium 120 transversal to the transport direction 1, meaning along the width of the recording medium 120.

In an exemplary embodiment, the printer 100 also includes a controller 101 (e.g. an activation hardware and/or a processor) that is configured to activate the actuators of the individual nozzles 21, 22 of the individual print heads 103 of the print group 140 in order to apply the print image onto the recording medium 120 depending on print data. In an exemplary embodiment, the controller 101 includes processor circuitry that is configured to perform one or more operations and/or functions of the controller 101, including: activating the actuators based on print data, induce one or more drives to produce a forward and backward movement of the recording medium 120 in preparation for a stop of the printer 100, so that a first segment of the recording medium 120 is arranged at least partially before or at least partially after the roller during the forward and backward movement, induce the drive to stop the movement of the recording medium 120 so that the first segment of the recording medium 120 is in contact with the roller during the stop of the printer 100, and/or controlling to operation of the printer 100 (including controlling one or more components of the printer 100).

The print group 140 of the printer 100 thus includes at least one print bar 102 with K nozzles 21, 22 that may be activated with a defined line clock cycle in order to print a line, which line travels transversal to the transport direction 1 of the recording medium 120, with K pixels or K columns 31, 32 of a print image onto the recording medium 120, for example with K>1000. In the depicted example, the nozzles 21, 22 are immobile or permanently installed in the printer 100, and the recording medium 120 is directed past the stationary nozzles 21, 22 with a defined transport velocity.

Figure 2:
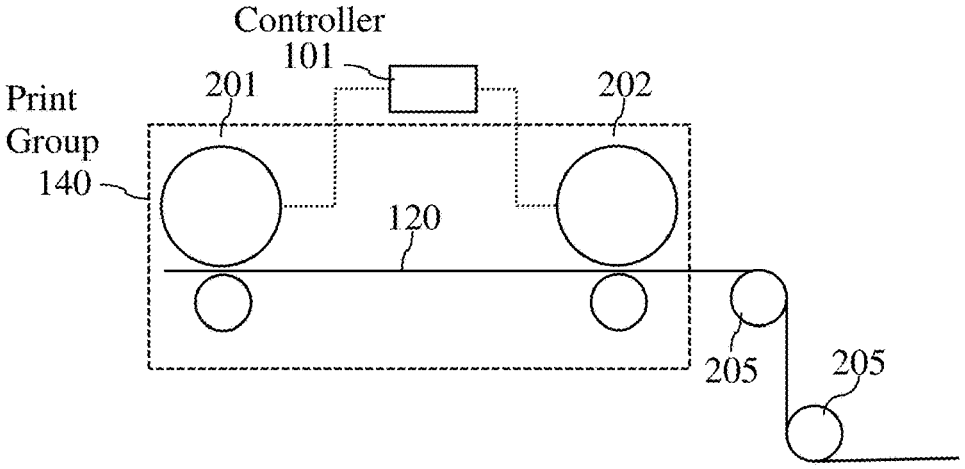
FIG. 2 illustrates rollers in a printer according to an exemplary embodiment of the present disclosure.

In an exemplary embodiment, the printer 100 includes a plurality of rollers in order to guide a recording medium 120 through said printer 100. FIG. 2 shows an example of rollers of a printer 100 according to an exemplary embodiment. For example, using rollers, one or more drives 201, 202 may be provided that are configured to drive a recording medium 120, and thus to guide said recording medium 120 through the printer 100, in particular through the print group 140 of the printer 100. For example, a first drive 201 may be provided at the input of a print group 140, and a second drive 202 may be provided at the output of a print group 140. The tension of the recording medium 120 in the print group 140 may be set via adaptation of the drive speeds of the two drives 201, 202. The one or more drives 201, 202 may thereby be configured to move the recording medium 120 in the forward direction, i.e. along the transport direction 1, and/or in the backward direction, i.e. counter to the transport direction 1.

In an exemplary embodiment, the printer 100 also includes one or more deflection rollers 205 configured to alter the alignment of the recording medium 120 within the printer 100.

The printer 100 is operated in a start-stop mode so that the movement of the recording medium 120 may be stopped as needed. A stop of the printer 100 leads to the situation that a segment of a recording medium 120 is in contact with the shell surface of a (deflection) roller 205 for the time period of the stop. The contact between a segment of the recording medium 120 and the shell surface of the roller 205 may in particular take place during a time period in which one or more climatic properties of the recording medium 120 adapt to corresponding climatic properties of the roller 205 and/or of the local environment of the recording medium 120. Examples of climatic properties are the temperature and/or the degree of moisture. The adaptation to the climatic properties of the local environment thereby takes place in a different manner in the segment of the recording medium 120 that is in contact with the roller 205 than in a segment of the recording medium 120 that is not in contact with the roller 205. In particular, in the first instance only one side of the recording medium 120 is exposed to the environment of the roller 205, whereas in the second instance both sides of the recording medium 120 are exposed to the environment of the roller 205.

These different conditions of adaptation to the local environment may lead to deformations of the recording medium 120 given a stop of the printer 100. In particular, rhomboidal deformations 301, as shown in FIG. 3*a*, may occur in the region of the contact between recording medium 120 and roller 205. Alternatively or additionally, due to the wrapping of the roller 205, a roller-shaped deformation or a curl 302 may occur at the segment of the recording medium 120 that was in contact with the roller 205 during the stop of the printer 100. These deformations 301, 302 may lead to a reduced print quality, and possibly to spoilage.

Given a printer 100 that is operated in start-stop mode, herringbone-like or rhomboidal waves 301 may thus form in the standing recording medium 120 at the deflection rollers 205 after stopping. In addition to this, a "curl" 302, i.e. an arc-shaped deformation of the recording medium 120, which approximately corresponds to the radius of the respective wrapped deflection roller 205, may respectively form in the recording medium 120 in the wrap region of the roller 204. These deformations 301, 302 may be differently strongly pronounced depending on paper moisture and/or roller temperature. Furthermore, deformations 301, 302 may respectively form at and/or immediately before and after the wrap region of the rollers 205. If these deformed regions should be printed to upon restarting, in order to avoid spoilage, this may lead to problems in the post-processing, and possibly to a reduced print quality, since the deformations of the recording medium 120 may also be visible in the finished print product.

In order to remove or reduce the deformations from a recording medium 120 again, the recording medium 120, which has possibly been cut into sheets, may be re-humidified and subsequently stored in a stack. Alternatively, the portion of the recording medium 120 that stands within a printer 100 during a stop may be disposed of, whereby the spoilage proportion is increased. The costs for producing a print product are increased by both of the aforementioned solutions.

In an exemplary embodiment, as depicted in FIG. 4*a*, a defined segment 401 of the recording medium 120 is in contact with the shell surface of the roller 205 during the stop of the printer 100. As depicted in FIGS. 3*a* and 3*b*, this segment 401 may deform during the stop of the printer 100. In an exemplary embodiment, in preparation for the stop of the printer 100, an alternating and repeated forward and backward movement of the recording medium 120 may be produced so that the segment 401 of the recording medium 120 that is in contact with the shell surface of the roller 205 varies.

The forward and backward movement of the recording medium 120 may have a defined movement extent or travel path 402, as depicted in FIG. 4*a*. The travel path 402 in each direction of the movement may thereby correspond to the portion of the circumference of the roller 205 that is in contact with the recording medium 120. In particular, the segment 401 of the recording medium 120 that is in contact with the roller 205 given the stop of the printer 100 may be directly moved entirely before the roller 205 given a backward movement, and entirely after the roller 205 given a forward movement. It may thus be produced that no segment of the recording medium 120 is non-transiently in contact with the roller 205 in the preparation for the stop of the printer 100.

As was already presented above, during the operation of the printer 100 the recording medium 120 may exhibit one or more climatic properties, for example a defined temperature and/or a defined humidity. FIG. 4*b* illustrates the value 411 of a climatic property of the recording medium 120 during the operation of the printer 100.

The value 412 of a climatic property 410 of the environment of the recording medium 120 or of the environment of the roller 205 may differ from the value 411 of the climatic property 410 of the recording medium 120. As a result of this, a stop of the printer 100 may lead to the situation that the recording medium 120 little by little assumes the value 412 of the climatic property 410 of the environment. It may thus lead to a time curve 414 of the value of a climatic property 410. This time curve 414 may be experimentally determined in advance and, if applicable, be stored as characteristic data.

In particular, from the time curve 414 a duration 415 may be determined that is necessary for the value 411 of the climatic property 410 of the recording medium 120 at the beginning of a stop to adapt to a threshold 413, wherein the threshold is, for example, 10% or 5% above the value 412 of the climatic property 410 of the environment. This duration 415 may be used as the duration, in particular the minimum duration, for the repeated forward and backward movements of the recording medium 120 in preparation for a stop of the printer 100. In other words, the repeated forward and backward movements of the recording medium 120 may be executed until the value 411 of one or more climatic properties 410 of the recording medium 120 has at least approximately adapted to the value 412 of the one or more climatic properties 410 of the environment. It may thus be ensured that, during the stop of the printer 100, an adaptation of the recording medium 120 to the one or more climatic properties 410 of the environment at least approximately no longer takes place, and thus also at least approximately no deformation 301, 302 of the recording medium 120 is produced.

After the stop, or in preparation for an ultimate stop, the recording medium 120 in the form of a web may thus still be moved forward and backward, in particular slowly, for a certain duration 415. This movement of the recording medium 120 may be referred to as an oscillating movement. The regions 401 of the recording medium 120 that otherwise come to rest on the one or more rollers 205, and therefore are hindered in their equalization of moisture and temperature with the ambient air, may thus be adapted to the ambient air similar to the free regions of the recording medium 120. The travel path 402 that is necessary for the oscillating movement may, for instance, correspond to the length of the wrap of the recording medium 120 on the respective roller 205. If a roller 205 produces a relatively small wrap of the recording medium 120 (for example of 20%, 10%, or less of the circumference of the roller 205, the travel path 402 may thus be increased relative to the length of the wrap (for example by a factor of 1.5 or 2 or more).

Deformations 301, 302 that arise due to the different swelling and shrinking processes of the web-shaped recording medium 120 in the various regions may thus be reliably and efficiently avoided. If the recording medium 120 has adapted fully or nearly fully to the ambient climate, the repeating forward and backward movement may be adjusted. Via the described measures, the curl 302 of a recording medium 120 may also be reduced or avoided, since the recording medium 120 is not continuously exposed to the same wrap (curvature) in the cooling and moisture equalization phase.

FIG. 5 shows a flowchart of a method 500 for reducing the deformation 301, 302 of a recording medium 120, according to an exemplary embodiment, in the form of a web as a result of a stop of a printer 100. In an exemplary embodiment, the printer 100 includes at least one roller 205, in particular at least one deflection roller, for guidance of the recording medium 120. Furthermore, the printer 100 may have at least one drive 201, 202 that is configured to move the recording medium 120. In particular, during a printing operation of the printer 100 the drive 201, 202 may be moved so that the recording medium 120 is moved through the printer 100 along the determined transport direction 1. The roller 205 of the printer 100 may be used to guide the recording medium 120 given its movement through the printer 100. The roller 205 may thereby have a defined wrap length along the transport direction 1. In other words, the recording medium 120 may be in contact with the surface shell of the roller 205 over a defined wrap length along the transport direction 1.

In an exemplary embodiment, the method 500 includes the implementation 501 of a forward and backward movement of the recording medium 120 in preparation for a stop of the printer 100. The forward and backward movement may thereby take place such that a first segment 401 of the recording medium 120 is arranged at least partially before or at least partially after the roller 205. The terms "before the roller 205" or "after the roller 205" thereby relate to the transport direction 1 of the recording medium 120 during the print operation.

In particular, the forward and backward movement may have at least one forward movement segment in which the first segment 401 of the recording medium 120 is directed at least partially beyond the roller 205 after said roller 205. Furthermore, the forward and backward movement may have at least one backward movement segment in which the first segment 401 of the recording medium 120 is directed at least partially back across the roller 205 before said roller 205. To implement the forward and backward movement, the drive 201, 202 of the printer 100 may be configured to produce both a forward and a backward movement of the recording medium 120.

In an exemplary embodiment, following the implementation 501 of the forward and backward movement, the method 500 includes the stopping 502 of the movement of the recording medium 120 so that the first segment 401 of the recording medium 120 is in contact with the roller 205 during the stop of the printer 100. For this purpose, the movement of the recording medium 120 may have a positioning movement segment in which the first segment 401 of the recording medium 120 is positioned, in particular entirely positioned, on the roller 205. The positioning of the first segment 401 of the recording medium 120 on the shell surface of the roller 205 may thereby take place using a forward movement or using a backward movement of the recording medium 120.

Via the implementation of a forward and backward movement of the recording medium 120 in preparation for a stop of the printer 100, it may be produced that the recording medium 120, in particular the first segment 401 of the recording medium 120, may adapt at least partially to the local conditions or climatic properties 410 of the direct environment of the roller 205 before the first segment 401 of the recording medium 120 comes to a standstill at the roller 205. Deformations 301, 302 of the recording medium 120, in particular of the first segment 401 of the recording medium 120, may thus be reduced or entirely avoided.

In preparation for the stop of a printer 100, a forward and backward movement of the recording medium 120 in the form of a web is thus implemented so that the first segment 401 of the recording medium 120, which is in contact with a roller 205 of the printer 100 given the stop of the printer 100, is moved at least partially before or after the roller 205. In preparation for the stop, climatic properties 410 of the recording medium 120 may thus be adapted to the climatic properties 410 of the local environment of the roller 205, whereby deformations 301, 302 of the recording medium 120 may at least be reduced.

The forward and backward movement may be a repeated forward and backward movement. In particular, the forward and backward movement may if applicable have multiple forward movement segments and/or backward movement segments that are repeated in alternation. For example, the forward and backward movement may have 2, 3, 4, 5, or more forward movement segments and/or backward movement segments. A particularly reliable and uniform adaptation of the first segment 401 of the recording medium 120 to the climatic properties 410 of the direct environment of the roller 205 may be produced via a repeated implementation of the forward and backward movement. Deformations 301, 302 of the recording medium 120 may thus be particularly reliably reduced.

As has already been presented above, the roller 205 typically has a defined wrap length so that the length of the first segment 401 of the recording medium 120 corresponds to the wrap length along the transport direction 1 of the recording medium 120. In other words, the first segment 401 may be in contact with the roller 205 over the wrap length of the roller 205. The forward and backward movement may then have a travel path 402 that corresponds to at least the wrap length, so that at least half of the length of the first segment 401 is arranged before or after the roller 205 during the forward and backward movement.

In an exemplary embodiment, the travel path 402 corresponds to at least or precisely three times the wrap length of the roller 205. It may thus be produced that the entire length of the first segment 401 is at least temporarily arranged before or after the roller 2105 during the forward and backward movement.

Via such a selected travel path 402 of the forward and backward movement, a particularly reliable and uniform adaptation to the local climatic properties 410 of the environment of the roller 205 may be produced. Within the scope of the forward and backward movement, the recording medium 120 may be moved in a forward direction on the travel path 402 in a forward movement segment. Furthermore, the recording medium 120 may be moved in a backward direction on the travel path 402 in a backward movement segment.

On the one hand, the travel path 402 may have a defined minimum length in order to ensure that, within the scope of the forward and backward movement, each segment of the recording medium 120 is at least temporarily not in contact with the shell surface of the roller 205. On the other hand, the travel path 402 of the forward and backward movement may be limited to a maximum length, for example at most 10 times, 5 times, or 4 times the wrap length. It may thus be ensured that an adaptation of the recording medium 120 to the local climatic properties 410 at the roller 205 takes place.

The forward and backward movement may be implemented for a defined duration 415. The duration 415 may thereby depend on how quickly a climatic property 410 of the recording medium 120, in particular the temperature and/or the degree of moisture, adapts to the corresponding climatic property 410 of the environment of the recording medium 120 or the environment of the roller 205. The required duration 415 may be determined experimentally in advance, for example for one or more different types of recording media 120. The duration 415 may thus depend on the type of recording medium 120. The type of recording medium 120 that is printed to in the printer 100 may be determined within the scope of the method 500. The duration 415 may then be set depending on the determined type of recording medium 120. For this purpose, the experimentally determined durations 415 for different types of recording media 120 may be provided as characteristic data.

The duration 415 may be so long that, after expiration of said duration 415, a value 411 of the climatic property 410 of the recording medium 120 has adapted by at least 10%, statistically on average, to a value 412 of the climatic property 410 of the environment.

Deformations 301, 302 of the recording medium 120 may be particularly reliably reduced or avoided via the implementation of the forward and backward movement of the recording medium 120 for a defined duration 415.

Within the scope of the method 500, sensor data may be recorded with regard to the value 411 of a climatic property 410 of the recording medium 120, in particular of the first segment 401 of the recording medium 120, and sensor data may be recorded with regard to the value 412 of the corresponding climatic property 410 of the direct environment of the roller 205. The forward and backward movement of the recording medium 120 may then be implemented until it is determined, on the basis of the sensor data, which the value 411 of the climatic property 410 of the recording medium 120 has adapted by 20%, 10%, or less to the value 412 of the climatic property 410 of the environment. Deformations 301, 302 of the recording medium 120 may be particularly reliably reduced or avoided via the determination and consideration of sensor data.

In the printing operation in which the recording medium 120 is printed to, the printer 100 transports the recording medium 120 at a print transport velocity. The forward and backward movement may be implemented with a transport velocity that is at least 5 times faster than the print transport velocity. A relatively slow forward and backward movement may thus take place in order to produce an optimally uniform adaptation of the recording medium 120 to the climatic properties 410 of the local environment of the roller 205. The print transport velocity may thereby be between $20^{m/min}$ and $240^{m/min}$, depending on the application.

In an exemplary embodiment, the printer 100 is configured to print to a recording medium 120 in the form of a band/paper web. In an exemplary embodiment, the printer 100 includes at least one drive 201, 202 that is configured to move the recording medium 120. Moreover, the printer 100 includes at least one roller 205 to guide the recording medium 120. In an exemplary embodiment, the printer 100 includes a controller 101 that is configured to induce the drive 201, 202 to produce a forward and backward movement of the recording medium 120 in preparation for a stop of the printer 100, so that a first segment 401 of the recording medium 120 is arranged at least partially before or at least partially after the roller 205 during the forward and backward movement. Furthermore, the controller 101 is configured to, following this, induce the drive 201, 202 to stop the movement of the recording medium 120 so that the first segment 401 of the recording medium 120 is in contact with the roller 205 during the stop of the printer 100.

Via the measures described in this document, deformations 301, 302 of a recording medium 120 in the form of a web that may arise given a stop of the printer 100 may be advantageously avoided, or at least reduced, reliably and efficiently, in particular without additional costs.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
2 movement direction (of a print bar)
21, 22 nozzle
31, 32 column (of the print image)
100 printer
101 controller
102 print bar
103 print head

120 recording medium
201, 202 drive
205 (deflection) roller
301 rhomboidal deformation
302 roller-shaped deformation/curl
401 segment (recording medium)
402 movement extent/travel path
410 climatic property
411 initial value (recording medium)
412 final value (environment)
413 threshold
414 time curve/characteristic data
415 duration of the forward and backward movement
500 method for reducing the deformation of a recording medium
501-502 method steps

The invention claimed is:

1. A method for reducing a deformation as a result of a stop of a printer including at least one roller for guiding the recording medium, the method comprising:

implementing a forward and backward movement of the recording medium for a duration, in preparation for the stopping of the printer, to arrange a first segment of the recording medium at least partially before or at least partially after the at least one roller, wherein the duration is dependent on an adaptation of a climatic property of the recording medium to a corresponding climatic property of an environment of the recording medium; and stopping movement of the recording medium so that the first segment of the recording medium is in contact with the roller when the printer is stopped.

2. The method according to claim 1, wherein:

the at least one roller includes a wrap length so that a length of the first segment of the recording medium along a transport direction of the recording medium corresponds to the wrap length; and the forward and backward movement exhibits a travel path that corresponds to at least the wrap length to arrange at least half of the length of the first segment before or after the roller during the forward and backward movement.

3. The method according to claim 2, wherein the travel path of the forward and backward movement corresponds to at most 10 times the wrap length.

4. The method according to claim 2, wherein the travel path of the forward and backward movement corresponds to at most five times the wrap length.

5. The method according to claim 2, wherein the travel path of the forward and backward movement corresponds to at most four times the wrap length.

6. The method according to claim 1, wherein the forward and backward movement is implemented such that each segment of the recording medium is at least temporarily not in contact with a shell surface of the at least one roller.

7. The method according to claim 1, wherein climatic property of the recording medium comprises a temperature of the recording medium and/or a degree of moisture of the recording medium.

8. The method according to claim 1, wherein the duration depends on a type of the recording medium.

9. The method according to claim 1, further comprising:

determining a type of the recording medium that is printed to in the printer; and setting the duration based on the determined type of the recording medium.

10. The method according to claim 1, wherein the duration is defined such that, after expiration of the duration, a value of the climatic property of the recording medium has been adapted by at least 10% to a value of the climatic property of the environment.

11. The method according to claim 1, wherein:

the printer is configured to transport the recording medium at a printing transport velocity in a printing operation in which the recording medium is printed to; and the forward and backward movement is implemented with a transport velocity that is faster than the printing transport velocity.

12. The method according to claim 11, wherein the transport velocity of the forward and backward movement is at least five times faster than the printing transport velocity.

13. The method according to claim 1, wherein the forward and backward movement comprises:

at least one forward movement segment in which the first segment of the recording medium is guided at least partially beyond the at least one roller after the at least one roller;

at least one backward movement segment in which the first segment of the recording medium is guided at least partially back across the at least one roller before the at least one roller; and at least one positioning movement segment in which the first segment of the recording medium is positioned on the at least one roller.

14. The method according to claim 1, wherein the forward and backward movement comprises multiple forward movement segments and multiple backward movement segments that are repeated in alternation.

15. The method according to claim 1, wherein the recording medium is a web-type recording medium.

16. A non-transitory computer-readable storage medium with an executable program stored thereon, that when executed, instructs a processor to perform the method of claim 1.

17. A printer for printing to a recording medium, comprising:

at least one drive that is configured to move the recording medium;

at least one roller configured to guide the recording medium; and a controller that is configured to:

induce the at least one drive, in preparation for a stop of the printer, to produce a forward and backward movement of the recording medium for a duration, to arrange a first segment of the recording medium at least partially before or at least partially after the at least one roller during the forward and backward movement, wherein the duration is dependent on an adaptation of a climatic property of the recording medium to a corresponding climatic property of an environment of the recording medium; and induce the drive to stop a movement of the recording medium so that the first segment of the recording medium is in contact with the roller when the printer is stopped.

18. A method for reducing a deformation as a result of a stop of a printer including at least one roller for guiding the recording medium, the method comprising:

implementing a forward and backward movement of the recording medium, in preparation for the stopping of the printer, to arrange a first segment of the recording medium at least partially before or at least partially after the at least one roller, wherein the forward and backward movement includes multiple forward movement segments and multiple backward movement segments that are repeated in alternation; and stopping movement of the recording medium so that the first segment of the recording medium is in contact with the roller when the printer is stopped.

19. A non-transitory computer-readable storage medium with an executable program stored thereon, that when executed, instructs a processor to perform the method of claim 18.

20. A printer for printing to a recording medium, comprising:

at least one drive that is configured to move the recording medium;

at least one roller configured to guide the recording medium; and a controller that is configured to perform the process as claimed in claim 18.

* * * * *